US009096359B2

(12) United States Patent
Pucci et al.

(10) Patent No.: US 9,096,359 B2
(45) Date of Patent: Aug. 4, 2015

(54) CLOSURE FOR A CONTAINER OF A POURABLE PRODUCT

(71) Applicant: TETRA LAVAL HOLDINGS & FINANCE S.A., Pully (CH)

(72) Inventors: Fabrizio Pucci, Castel Guelfo di Bologna (IT); Mats Qvarford, Lund (SE); Bo Larsson, Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/378,057

(22) PCT Filed: Feb. 14, 2013

(86) PCT No.: PCT/EP2013/052921

§ 371 (c)(1),
(2) Date: Aug. 11, 2014

(87) PCT Pub. No.: WO2013/124199

PCT Pub. Date: Aug. 29, 2013

(65) Prior Publication Data

US 2015/0034644 A1 Feb. 5, 2015

(30) Foreign Application Priority Data

Feb. 22, 2012 (EP) ..... 12156611

(51) Int. Cl.
*B65D 51/22* (2006.01)

(52) U.S. Cl.
CPC ..... *B65D 51/22* (2013.01); *B65D 51/228* (2013.01); *B65D 2251/0015* (2013.01); *B65D 2251/0071* (2013.01)

(58) Field of Classification Search
CPC ..... B65D 41/62; B65D 41/34; B65D 41/32; B65D 51/228; B65D 51/22; B65D 51/20; B65D 51/18
USPC ..... 215/253, 250, 316, 329, 228; 220/265, 220/315, 327, 212, 319, 345.1, 258.5, 220/258.3, 258.2, 258.1, 256.1; 222/153.1, 222/541.6, 541.1
See application file for complete search history.

(56) References Cited

U.S. PATENT DOCUMENTS 4,111,325 A 9/1978 Bellamy et al.
4,662,529 A 5/1987 Moore (Continued)

FOREIGN PATENT DOCUMENTS

DE 40 11 878 A1 10/1991
EP 0 194 068 A2 9/1986

(Continued)

OTHER PUBLICATIONS

International Search Report (PCT/ISA/210) mailed on May 23, 2013, by the European Patent Office as the International Searching Authority for International Application No. PCT/EP2013/052921.
Office Action issued by the European Patent Office on Apr. 2, 2015 in corresponding European Application No. 12156611.1. (6 pages).

*Primary Examiner* — Robert J Hicks
*Assistant Examiner* — Kareen Rush
(74) *Attorney, Agent, or Firm* — Buchanan Ingersoll & Rooney PC

(57) ABSTRACT

A container closure comprising a pouring spout having a neck defining a pour opening and a cover portion closing one end of the neck; a cap fittable to and removable from the spout and having a lateral wall cooperating with the neck and an end wall facing the cover portion; a weakening line on the end of the neck; first opening promoter on the spout; and second opening promoter on the lateral wall of the cap to engage the first opening promoter upon removing the cap from the spout to separate the cover portion from the neck along the weakening line; after separation, the cover portion is held by the second opening promoter in a containing zone of the cap; the closure further comprises flow hampering mechanism for limiting, after separation of the cover portion from the neck, the product flow towards and from the containing zone.

19 Claims, 8 Drawing Sheets

(56) References Cited

U.S. PATENT DOCUMENTS

| | | | | |
|---|---|---|---|---|
| 8,235,232 | B2 * | 8/2012 | Isogai et al. | 215/48 |
| 8,365,934 | B2 * | 2/2013 | Hamana et al. | 215/330 |
| 2006/0000793 | A1 * | 1/2006 | Mavin et al. | 215/253 |
| 2008/0272083 | A1 * | 11/2008 | Druitt | 215/252 |
| 2012/0292321 | A1 * | 11/2012 | Pucci | 220/255.1 |

FOREIGN PATENT DOCUMENTS

| | | | |
|---|---|---|---|
| EP | 2 371 733 | A1 | 10/2011 |
| WO | WO 2008/148764 | A2 | 12/2008 |

* cited by examiner

CLOSURE FOR A CONTAINER OF A POURABLE PRODUCT

TECHNICAL FIELD

The present invention relates to a closure for a container of a pourable product, in particular of food-type.

BACKGROUND OF INVENTION

As it is known, many pourable food products, such as fruit juice, milk, tomato sauce and beverages in general, are sold in a wide range of containers of different types and sizes, such as: parallelepiped-shaped packages made of multilayer, plastic- and/or paper-based, laminated materials or so-called multilayer cardboard materials; beaker-shaped plastic packages; blow-molded bottles; or glass, sheet metal or aluminium containers.

All these containers are fitted with closures which can be opened to allow access by the consumer to the food product, either to pour it into a drinking vessel or to consume it straight from the container.

Screw cap closures are commonly used on bottle-type containers, whereas containers made of multilayer cardboard materials are often simply provided with tear-off markers, or with pour openings formed in the containers and covered with pull tabs.

Containers made of multilayer cardboard materials are also known to be fitted with plastic closures injection molded directly onto the containers, about openings formed through the packaging material, so as to completely close and seal the openings. Closures of this sort normally define the pour opening of the container, which may be fitted, for example, with a screw or snap cap.

Another type of container is also known which comprises a main portion made of multilayer cardboard material, and a top, for pouring the liquid or pourable product in the container, made of plastic material and produced by blowing a plastic tubular preform or by thermoforming or even by other suitable forming techniques, such as compression or injection molding.

An example of a plastic top for this type of containers is illustrated in international patent application No. WO2008/148764 and in European patent application No. EP-A-2371733.

In both the applications, the plastic top basically comprises a pouring spout, defining the pour opening by which to pour the food product out of the container, and a cylindrical cap fitted to the pouring spout in a removable way.

The pouring spout may have one layer of gas- and/or light-barrier material, e.g. EVOH, and is produced, and attached to the container, in a closed configuration. In particular, the pouring spout comprises a substantially cylindrical tubular neck defining the pour opening and a cover portion integral with the neck and closing the pour opening.

More specifically, the neck has a bottom open end adapted to be attached to the container and a top end closed by the cover portion and provided with a weakening line, along which the cover portion can be detached from the neck when the container is opened by the user for the first time.

The cap is formed by an annular cylindrical lateral wall, which has an internal thread for engaging a corresponding thread provided on an outer lateral surface of the neck, and by a disk-shaped end wall for covering, in use, the top of the pouring spout.

In order to obtain the detachment of the cover portion from the neck, the lateral wall of the cap is provided with opening promoting means arranged for engaging further opening promoting means of the cover portion upon removal of the cap from the pouring spout to separate the cover portion from the neck along the weakening line.

In particular, according to one of the embodiments illustrated, the opening promoting means are defined by flap means having one end hinged to the lateral wall of the cap and one opposite end arranged for interacting with the further opening promoting means; the flap means may comprise a plurality of distinct flaps extending through the whole circumference of the neck.

Alternatively, the opening promoting means may comprise hook means projecting inside the cap.

In both cases, the further opening promoting means for cooperating with the flap or hook means comprise an annular rim of the cover portion radially protruding outwards so as to form an abutment surface transversal to the axis of the pouring spout.

The first opening of the container is accomplished by rotating the cap around its axis; thanks to the interaction of the threads, the cap is advanced along a stroke comprising a rotational component about its axis and a translational component along the same axis.

During this movement, the flap or hook means of the cap contact the protruding rim of the cover portion and slide therealong so exerting a lifting action on such rim for producing the detachment of the cover portion from the neck at the weakening line.

After detachment, the cover portion is held in the cap by the flap or hook means; in this condition, when the container is reclosed, part of the product, still present in the container, may flow towards the region comprised between the cover portion and the end wall of the cap so as to be here gathered. This phenomenon may occur more easily when, after the first opening, the container is stored, for instance in the fridge, in a horizontal position.

During subsequent opening and re-closing of the container, the product gathered in the region comprised between the cover portion and the end wall of the cap, may spill out of the cap, smearing the area around the container.

DISCLOSURE OF INVENTION

It is therefore an object of the present invention to provide a closure for a container of a pourable product, which is designed to eliminate the aforementioned drawback in a straightforward and low-cost manner.

This object is achieved by a closure for a container of a pourable product, as claimed in claim 1.

BRIEF DESCRIPTION OF THE DRAWINGS

A number of preferred, non-limiting embodiments of the present invention will be described by way of example with reference to the accompanying drawings, in which.

DETAILED DESCRIPTION OF PREFERRED EMBODIMENTS

Figure 1:
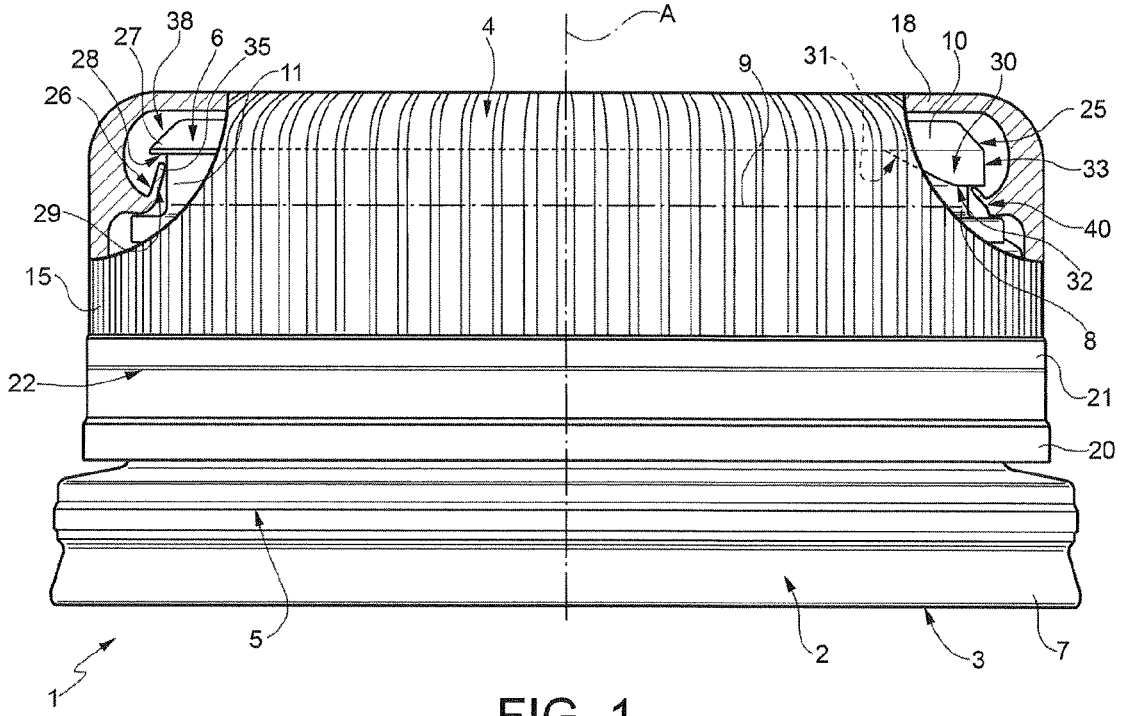
FIG. 1 shows a partially sectioned front view of a closure, in accordance with the present invention, for a container of a pourable product.
Figure 4:
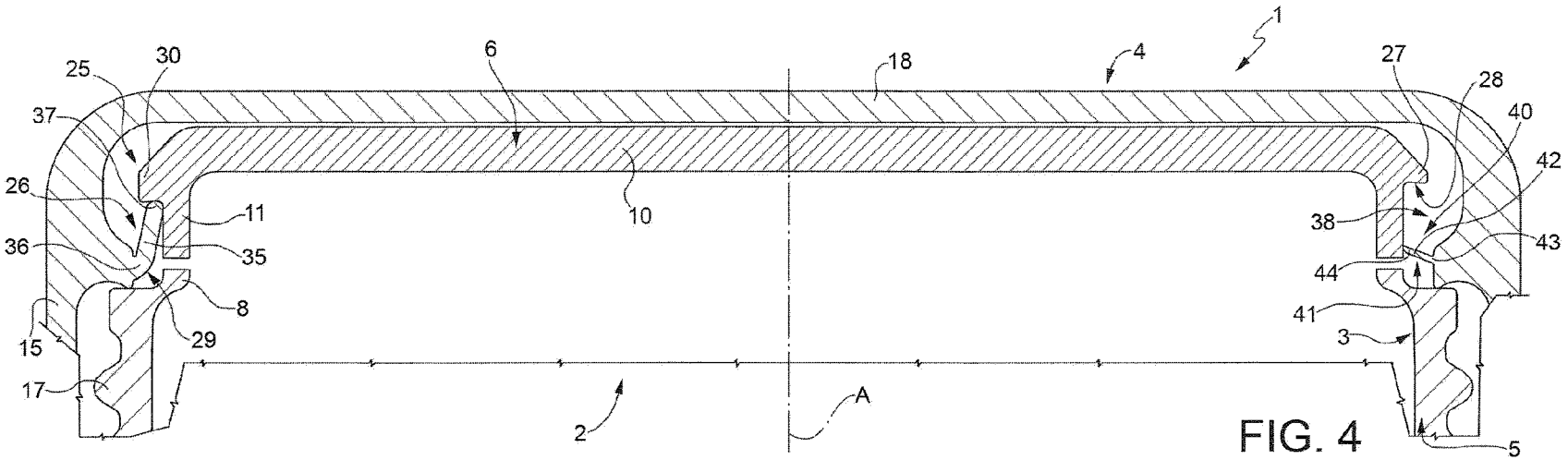
FIG. 4 shows a larger-scale axial section of the FIG. 1 closure in a reclosed configuration after a first opening of the closure itself.

Number 1 in FIGS. 1 and 4 indicates as a whole a closure for a container (not shown) of liquid or pourable food products, such as a plastic closure for a combined cardboard-plastic container—to which the following description refers purely by way of example.

Closure 1 has a longitudinal axis A and basically comprises a pouring spout 2, defining a pour opening 3 by which to pour the food product out of the container, and a cylindrical cap 4 fitted to pouring spout 2 in a removable way.

Pouring spout 2 may be applied to a top part or end wall of the container or even configured to define integrally the complete top of the container.

Pouring spout 2 may define a gas- and/or light-barrier and is produced, and attached to the container, in a closed configuration.

In particular, pouring spout 2 comprises a substantially cylindrical tubular neck 5, defining pour opening 3, and a cover portion 6 integral with neck 5 and closing pour opening 3.

More specifically, neck 5 has an open bottom end 7 adapted to be attached to the container and a top end 8 closed by cover portion 6 and provided with a weakening line 9 (only schematically shown in FIG. 1 with a dotted-dash line), along which the cover portion 6 can be detached from the neck 5 when closure 1 is opened by the user for the first time.

Weakening line 9 may extend along the entire annular peripheral region of top end 8 of neck 5 or only along one or more zones thereof; in the first case, weakening line 9 may consist of one continuous, non-through annular incision provided through the thickness of top end 8 of neck 5, whilst, in the second case, the weakening line 9 may consist of a plurality of said incisions spaced to each other.

In the example shown, cover portion 6 comprises a disk-shaped wall 10 orthogonal to axis A and having an axially protruding cylindrical annular edge 11 connected integrally to top end 8 of neck 5 through weakening line 9.

Cap 4 (FIGS. 1 to 4 and 8) is produced in a single piece and is substantially defined by an annular cylindrical lateral wall 15, which has an internal thread (FIG. 2), with one or more starts, for engaging a corresponding thread 17 (FIG. 4) provided on an outer lateral surface of neck 5, and by a disk-shaped end wall 18 for covering, in use, the top of pouring spout 2, and specifically wall 10 of cover portion 6; in practice, in use, end wall 18 faces cover portion 6 (FIGS. 1 and 4).

In an alternative embodiment not shown, lateral wall 15 of cap 4 may be internally provided with one or more cam projections suitable for engaging one or more corresponding projections on neck 5.

In other words, a cam arrangement is provided between cap 4 and neck 5 in order to allow the cap 4 to be fitted to and removed from pouring spout 2 along a stroke having a translational component parallel to axis A and a rotational component about such axis; this cam arrangement may be defined by the threads 16, 17, as shown in the example of the enclosed Figures, or even by proper cam devices.

Cap 4 is molded integrally, in the usual way, with a respective tamperproof ring 20 connected coaxially to a bottom edge 21 of lateral wall 15 by breakable connecting means 22, such as one annular breakable bridge or a number of radial breakable bridges.

Cap 4 is fitted initially to pouring spout 2 in a completely closed or sealed position (FIG. 1), wherein the cap 4 is screwed completely onto neck 5, with bottom edge 21 and tamperproof ring 20 still connected to each other and resting on opposite sides of an element (not visible) connected to a bottom portion of thread 17 of neck 5.

According to a possible alternative not shown, bottom edge 21 and tamperproof ring 20 may rest on opposite sides of an annular rib extending on the neck 5 at a lower position than thread 17 with respect to axis A.

Closure 1 further comprises first opening promoting means 25 (FIGS. 1 and 4) provided on the annular periphery of cover portion 6, and second opening promoting means 26 (FIGS. 1 to 4 and 8) provided on an inner surface of lateral wall 15 of cap 4 and arranged for engaging the first opening promoting means 25 upon removal of the cap 4 from the pouring spout 2 to separate cover portion 6 from neck 5 along the weakening line 9.

In particular, first opening promoting means 25 comprise an annular rim 27 of wall 10 of cover portion 6 radially protruding outwards with respect to annular edge so as to form an abutment surface 28 orthogonal to axis A; and second opening promoting means 26 comprise two or more opening elements 29, in the example shown three, provided on the inner surface of lateral wall 15 of cap 4, equally spaced angularly to each other around axis A and arranged to cooperate with the first opening promoting means 25.

First opening promoting means 25 further comprise a number of cam elements 30 (only one visible in FIG. 1), in the example shown three, equally spaced angularly around axis A, arranged on annular edge 11 and annular rim 27 for cooperating with respective opening elements along a portion of the removal stroke of the cap 4 from pouring spout 2; cam elements 30 are configured to enhance locally the translational component produced by thread 17 on thread 16 of cap 4 during the removal stroke.

In this way, when the cap 4 is rotated by the user about axis A for opening the closure 1 for the first time, the interaction of each opening element 29 with the corresponding cam element 30 produces a sudden change in the gear ratio defined by the pitch of thread 16 and thread 17 and a consequent corresponding increase of the tension in the plastic material so as to achieve a local fracture at a point of the weakening line 9 corresponding to the zone where the cam element 30 is placed or immediately adjacent thereto.

As visible in FIG. 1, each cam element 30 protrudes outwards from annular edge 11 and even from annular rim 27 towards neck 5 and weakening line 9.

In the example shown, cam elements 30 are identical to each other and have right-angled trapezium-shaped profiles.

In particular, by proceeding in the direction of rotation of cap 4 during removal from pouring spout 2 (anticlockwise in FIG. 1), each cam element 30 is delimited, towards neck 5, by a first ramp-shaped edge 31 extending obliquely with respect to axis A, by a second edge 32 parallel to rim 27 and orthogonal to axis A and by a third edge 33 parallel to axis A. In the example shown in FIG. 1, all edges 31, 32 and 33 have flat configurations.

More specifically, ramp-shaped edge 31 has, in a direction parallel to axis A, a distance from top end 8 of neck 5 decreasing in the direction of rotation of cap 4 during removal from pouring spout 2.

Ramp-shaped edge 31 of each cam element 30 is inclined in an opposite way with respect to the adjacent portion of thread 17, i.e. the portion of thread 17 arranged below said cam element 30.

It is pointed out that ramp-shaped edge 31 may also comprise a plurality of portions having different inclinations or may have a curvilinear shape.

Moreover, the cam elements 30 may have different profiles, such as isosceles trapezium-shaped or even triangle-shaped.

With reference to FIGS. 1, 2, 4 and 8, each opening element 29 comprises a flap 35 having one end 36 hinged on the inner surface of lateral wall 15 of cap 4 at a higher position than thread 16 with respect to axis A, and one opposite free end 37 arranged for interacting with the first opening promoting means 30.

Figure 2:
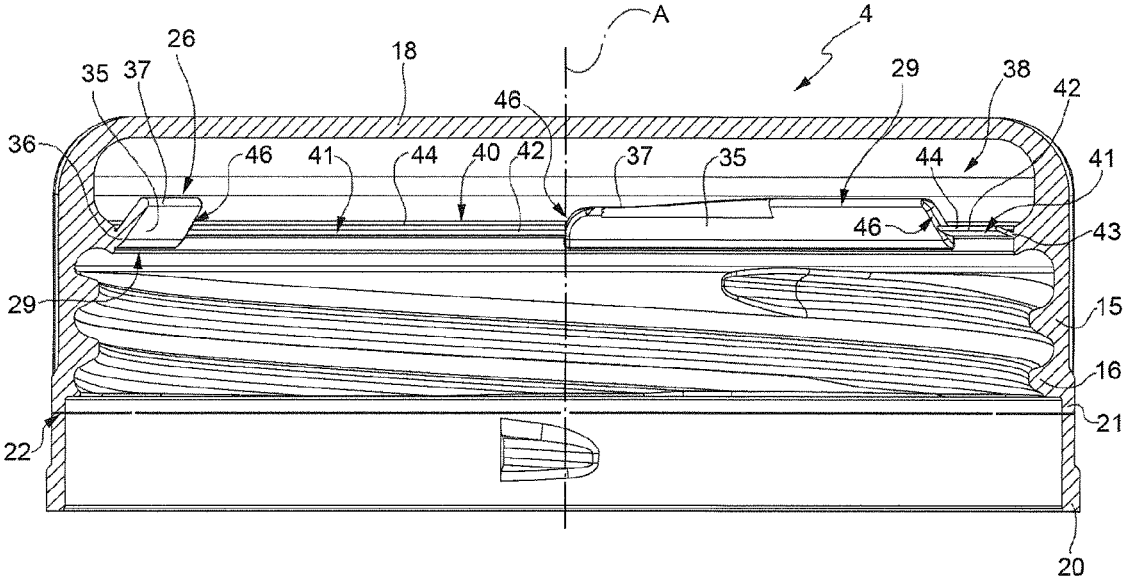
FIG. 2 shows an axial section of a cap of the FIG. 1 closure.
Figure 8:
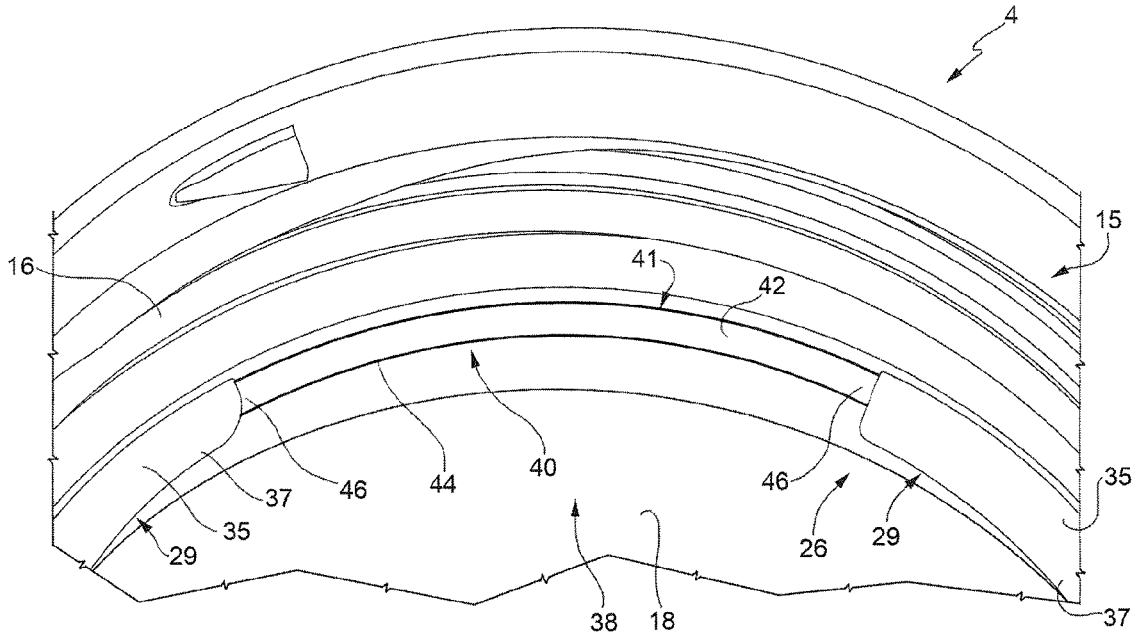
FIGS. 8 to 14 show larger-scale views in perspective of different possible variants of an inner part of the FIG. 2 cap.

As illustrated in FIGS. 2 and 8, each flap 35 has a variable height proceeding from one angular end to the opposite one; in particular, in the direction of rotation of cap 4 during removal from pouring spout 2 (anticlockwise in FIG. 2), the height of each flap 35 decreases from the downstream angular end to the upstream angular end.

Flaps 35 are configured in such a way that cover portion 6 is held by the cap 4 after being removed from the neck 5. In particular, cover portion 6 is held in a containing zone 38 of cap 4 defined by end wall 18, flaps 35 and the part of lateral wall 15 limited therebetween.

During fitting of cap 4 onto pouring spout 2 to obtain closure 1, flaps 35 are elastically deformed in such a way that cover portion 6 is received inside the containing zone 38 and cannot come off the latter unintentionally, i.e. without being deliberately extracted by the user.

According to a possible alternative not shown, each opening element 29 may be also defined by a rigid hook projecting inside the cap 4 from the lateral wall 15 thereof.

Before the cap 4 is removed from the pouring spout 2 for the first time, each cam element 30 and the corresponding opening element 29 are separated by a preset angular distance around axis A; this distance can be defined in such a way to obtain, during the first opening of closure 1, separation of tamperproof ring 20 from bottom edge 21 of lateral wall 15 along breakable connecting means 22 before the sudden increase of the force transmitted from the cap 4 to the cover portion 6 is produced as a result of the action of such cam elements 30 or even before each opening element 29 starts to interact with the respective cam element 30.

Moreover, before the cap 4 is removed from the pouring spout 2 for the first time, the free end 37 of each opening element 29 may be at a preset axial distance from the surface 28 of the annular rim 27 (FIG. 1) or even in contact with the latter.

Advantageously, closure 1 further comprises flow hampering means 40 for limiting, after separation of cover portion 6 from neck 5, the product flow towards and/or from containing zone 38 of cap 4.

In particular, flow hampering means 40 project inside the cap 4 from the lateral wall 15 thereof. Flow hampering means 40 have a size in a direction parallel to axis A smaller than the size of the second opening promoting means 26 in the same direction. In other words, flow hampering means 40 have a height smaller than the height of the second opening promoting means 26. In practice, flow hampering means 40 have an extension from lateral wall 15 of cap 4 smaller than the extension of second opening promoting means 26 from the same wall 15.

According to one embodiment of the present invention (FIGS. 1 to 4 and 8), flow hampering means 40 comprise a number of flow hampering elements 41, in the example shown three, which are angularly interposed between opening elements 29.

Each flow hampering element 41 comprises a flap 42 having one end 43 hinged to the inner surface of lateral wall 15 of cap 4 at a position interposed between thread and end wall 18, and one opposite free end 44 cooperating with or without contact with the cover portion 6. In particular, the free ends 44 of flow hampering elements 41 are designed to cooperate with or without contact with the outer surface of annular edge 11 of cover portion 6, in a position adjacent to weakening line 9. It is clear that the same barrier effect may be achieved by arranging the flow hampering elements 41 so as to cooperate with or without contact with another part of cover portion 6.

In the example shown, the free ends 44 of flaps 42 are in contact with the outer surface of annular edge 11 of cover portion 6.

It is clear that the flow hampering effect may be also obtained by configuring the flaps 42 so as to have the respective free ends 44 in partial contact with the outer surface of annular edge 11 of cover portion 6, i.e. touching the cover portion 6 in some regions and spaced of a small amount from the cover portion 6 in other regions, or even by configuring the flaps 42 so as to have the free ends 44 always spaced of a small amount from the outer surface of annular edge 11 of cover portion 6.

Figure 5:
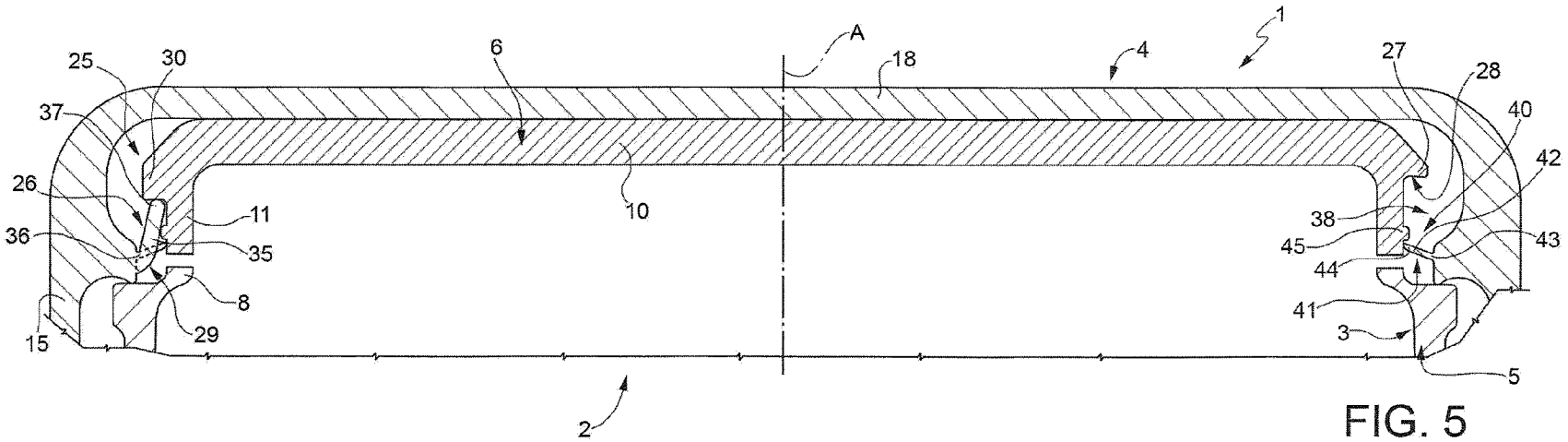
FIGS. 5 to 7 are respective sections analogous to the one of FIG. 4 showing three possible variants of the FIG. 1 closure.
Figure 6:
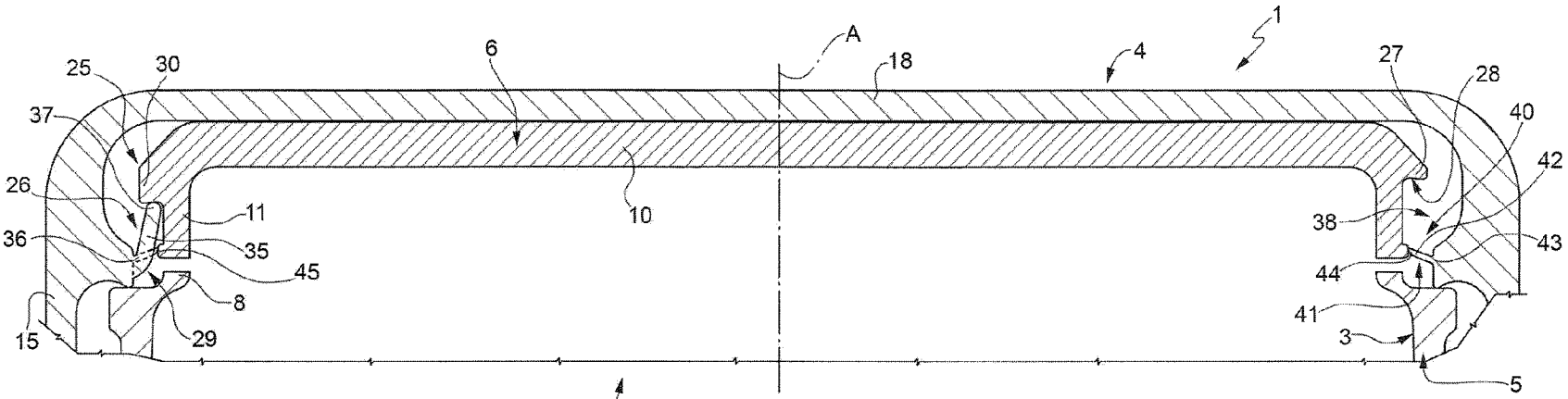
Figure 7:
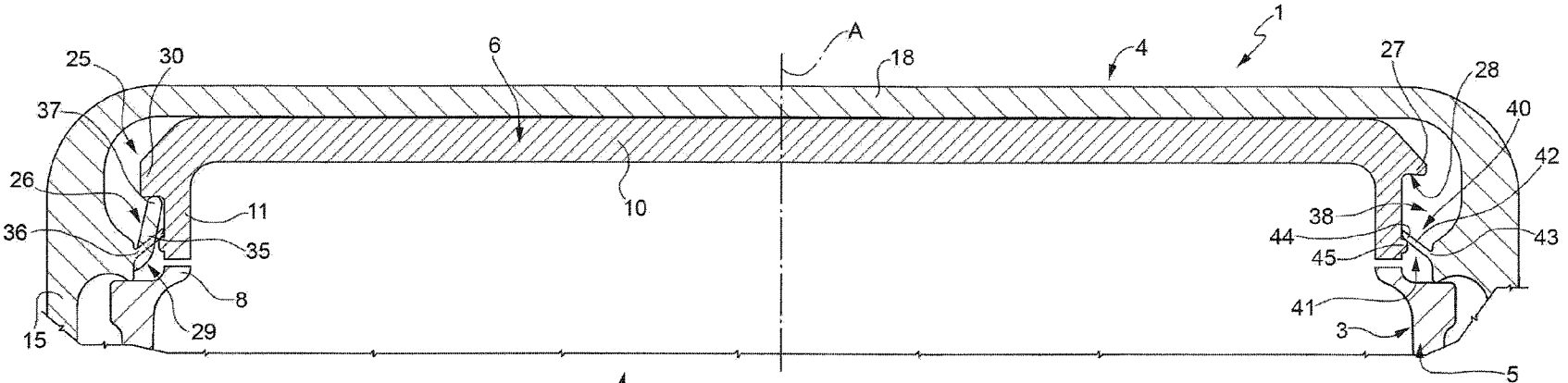

The variants of FIGS. 5 to 7 show three alternative configurations for the arrangement of flow hampering elements 41 with respect to annular edge 11 of cover portion 6.

In the solution of FIG. 5, an annular rib 45 is provided on the outer surface of annular edge 11 of cover portion 6 and radially protrudes from said edge 11 towards lateral wall 15 of cap 4; annular rib 45 is arranged for cooperating with or without contact with the free ends 44 of flow hampering elements 41. In particular, in this case, the free ends 44 of flow hampering elements 41 cooperate with or without contact with a bottom surface of annular rib 45 facing weakening line 9; in this way, the free ends 44 of flow hampering elements 41 are axially positioned between the weakening line 9 and the annular rib 45. In practice, in this configuration, flow hampering elements 41 define a rest for annular rib 45.

In the solution of FIG. 6, the free ends 44 of flow hampering elements 41 cooperate with or without contact with a front surface of annular rib 45 facing lateral wall 15 of cap 4; in other words, the free ends 44 of flow hampering elements 41 are placed substantially at the same axial height as the mentioned front surface of annular rib 45.

In the solution of FIG. 7, the free ends 44 of flow hampering elements 41 cooperate with or without contact with a top surface of the annular rib 45 facing the first opening promoting means 25, in the example shown the abutment surface 28, and therefore opposite the above-mentioned bottom surface of the annular rib 45; in this way, the free ends 44 of flow hampering elements 41 are axially positioned between the annular rib 45 and the abutment surface 28.

Figure 3:
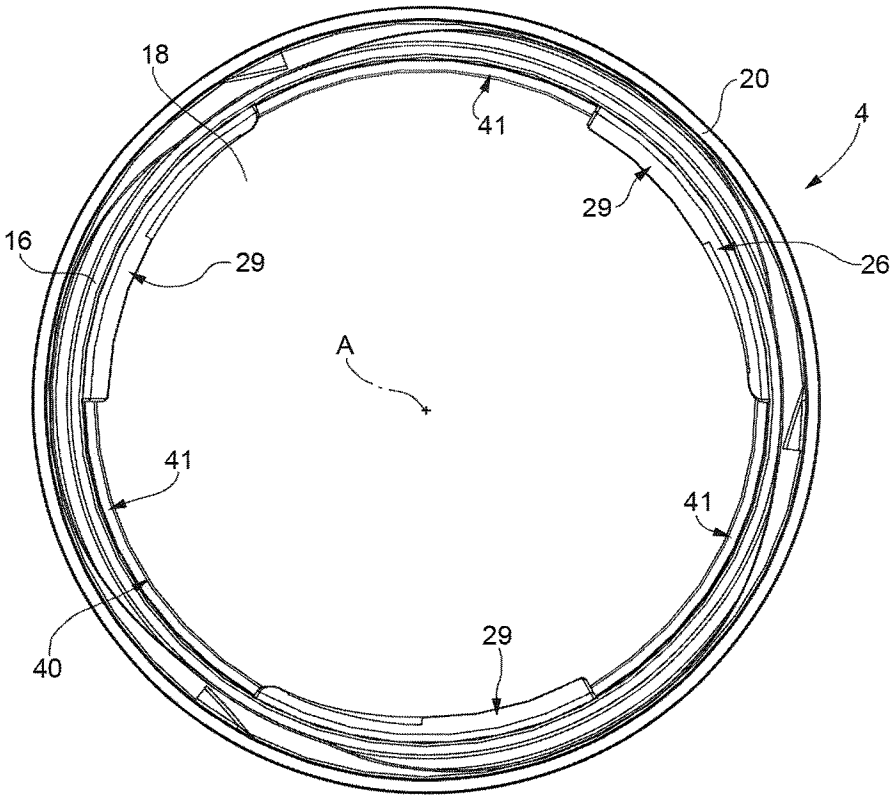
FIG. 3 shows a smaller-scale bottom view of the FIG. 2 cap.

As visible in FIGS. 2, 3 and 8, each flow hampering element 41 has opposite angular ends 46 contacting respective adjacent opening elements 29. In this case, each flow hampering element 41 has a constant extension from the lateral wall 15 of cap 4.

The variants of FIGS. 9 to 14 relate to possible different configurations of the flow hampering elements 41, which have increased flexibility permitting an easier manufacturing by molding and an easier initial assembly of the cap 4 on the pouring spout 2 so as to minimize the interaction forces and possible risks of damages.

Moreover, this increased flexibility permits the flow hampering elements 41 to return more easily to the desired flow hampering configuration after the initial fitting of cap 4 on pouring spout 2.

Figure 9:
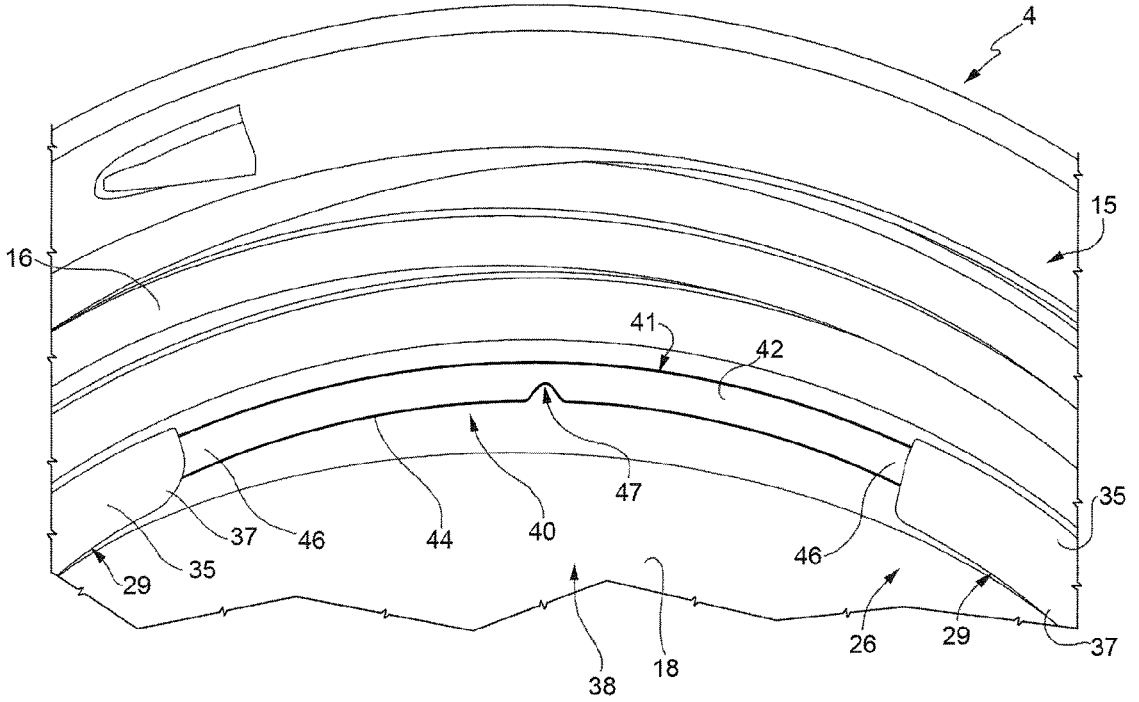

In particular, in the configuration of FIG. 9, each flow hampering element 41 has a partial cut 47 or a notch in a position interposed between the opposite angular ends 46; more specifically, the partial cut 47 is formed at an intermediate section of the relative flow hampering element 41.

Figure 10:
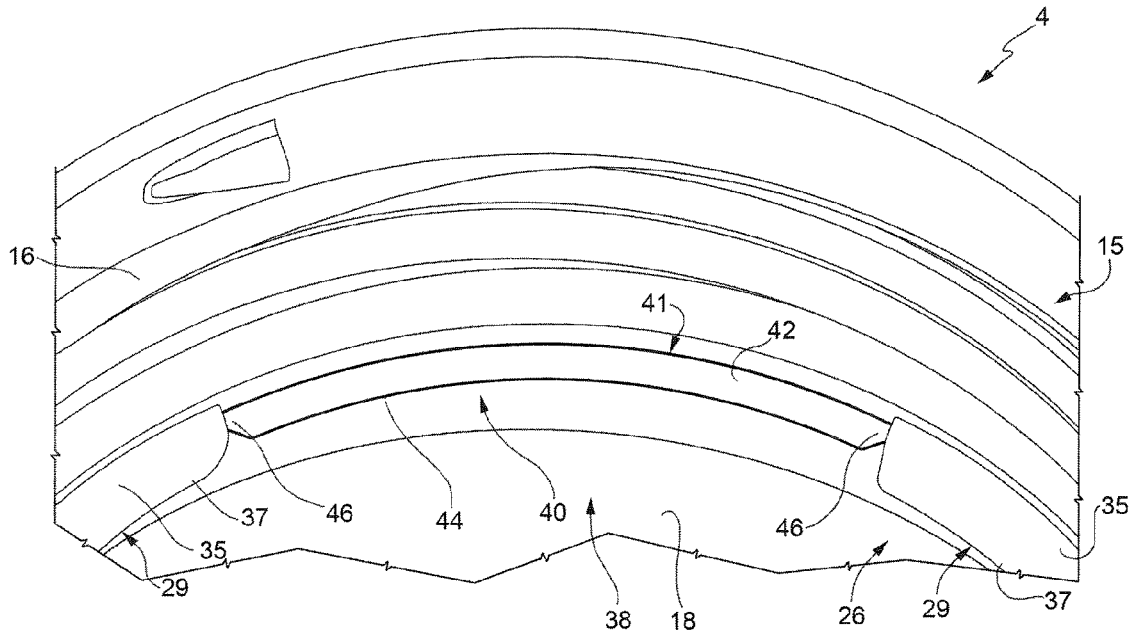

In the variant of FIG. 10, each flow hampering element 41 has the opposite angular ends 46 tapering to the respective adjacent opening elements 29; in this case, the remaining part of each flow hampering element 41 has a constant extension from the lateral wall 15 of cap 4.

Figure 11:
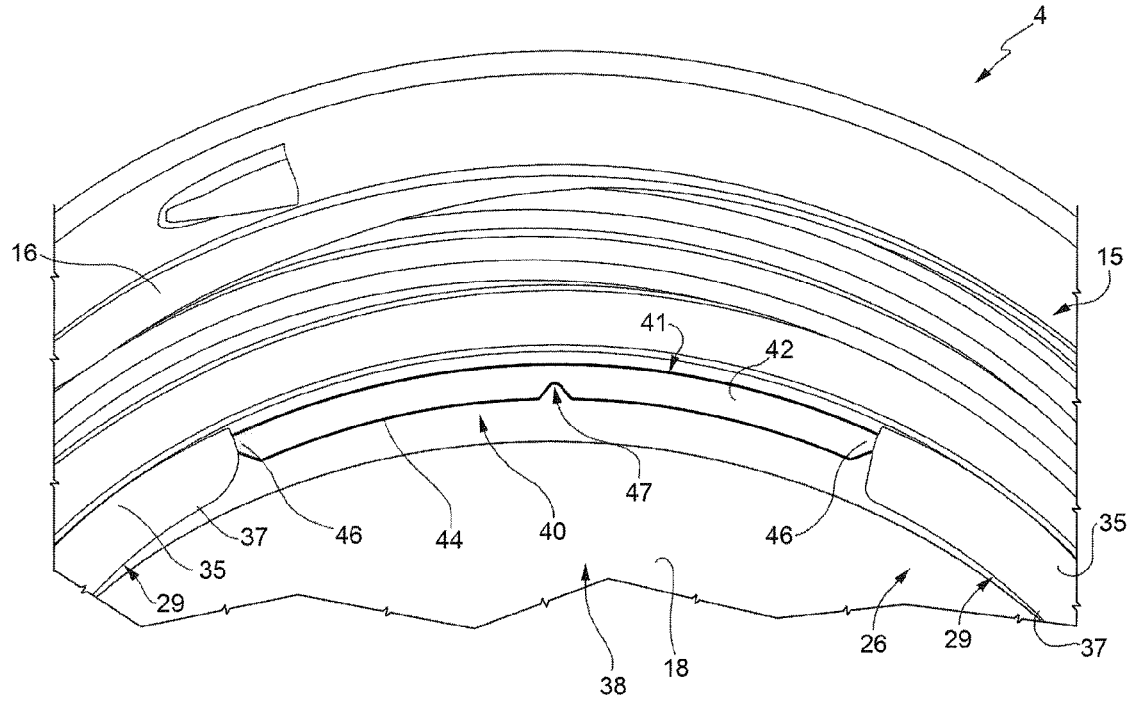

The flow hampering element 41 according to the solution shown in FIG. 11 has both the partial cut 47 as the variant of FIG. 9 and the tapering angular ends 46 as the variant of FIG. 10.

Figure 12:
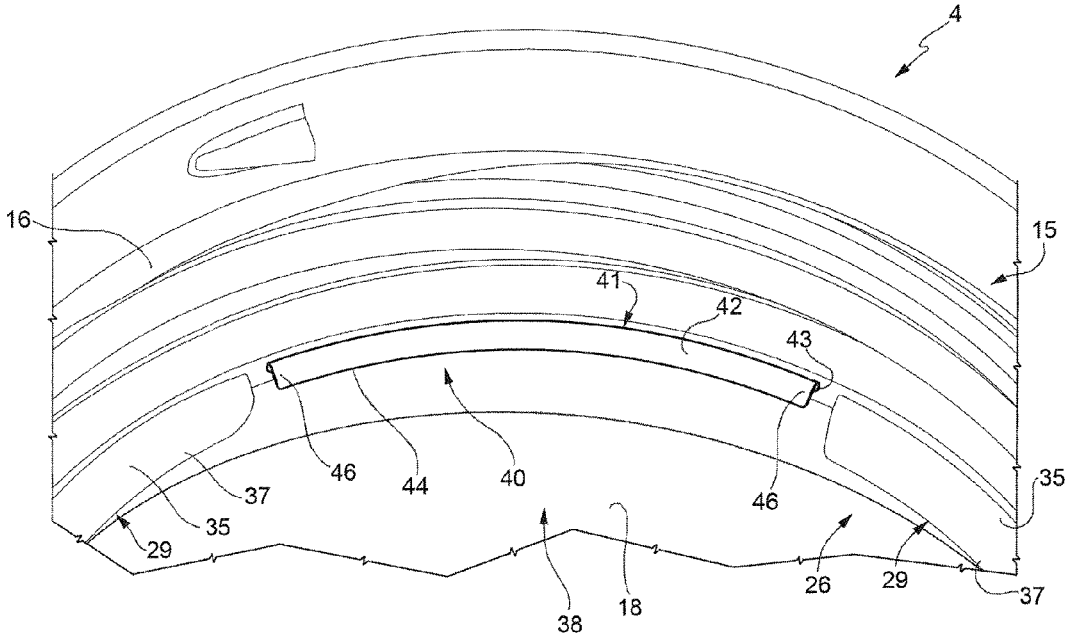

In the variant of FIG. 12, each flow hampering element 41 has the opposite angular ends 46 spaced of a small amount from the respective adjacent opening elements 29.

Figure 13:
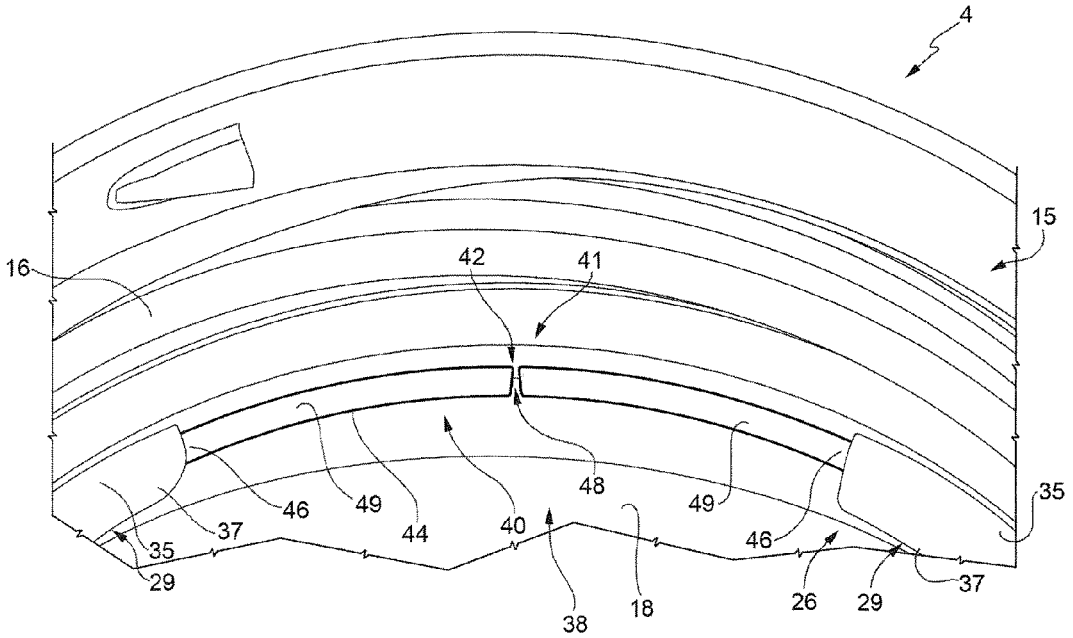

The variant of FIG. 13 differs from the variant of FIG. 9 in that each flow hampering element 41 has a through cut 48 instead of the partial cut 47; in this case, the through cut 48 divides the relative flow hampering element 41 in two separate portions 49, each one contacting the relative adjacent opening element 29.

More specifically, the through cut 48 is formed at an intermediate section of the relative flow hampering element 41; therefore, the portions 49, in which each flow hampering element 41 is divided by the relative through cut 48 are two halves of said element.

Figure 14:
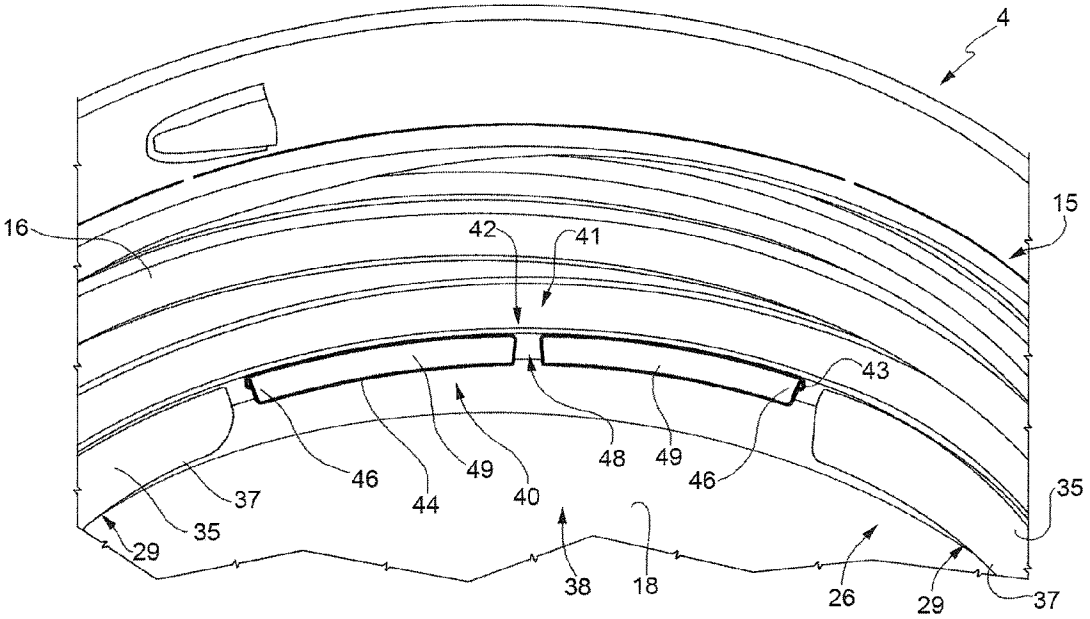

The flow hampering element 41 according to the solution shown in FIG. 14 has both the angular ends 46 separated from the respective adjacent opening elements 29 as in the variant of FIG. 12 and the through cut 48 as in the variant of FIG. 13.

According to another possible alternative not shown, each flow hampering element 41 may also have the opposite tapering angular ends 46 as in the variant of FIG. 10 and the intermediate through cut 48 as in the variant of FIG. 13.

According to a further possible alternative not shown, each flow hampering element 41 may also have opposite angular ends 46 separated from the respective adjacent opening elements 29 as in the variant of FIG. 12 and the intermediate partial cut 47 as in the variant of FIG. 9.

Figure 15:
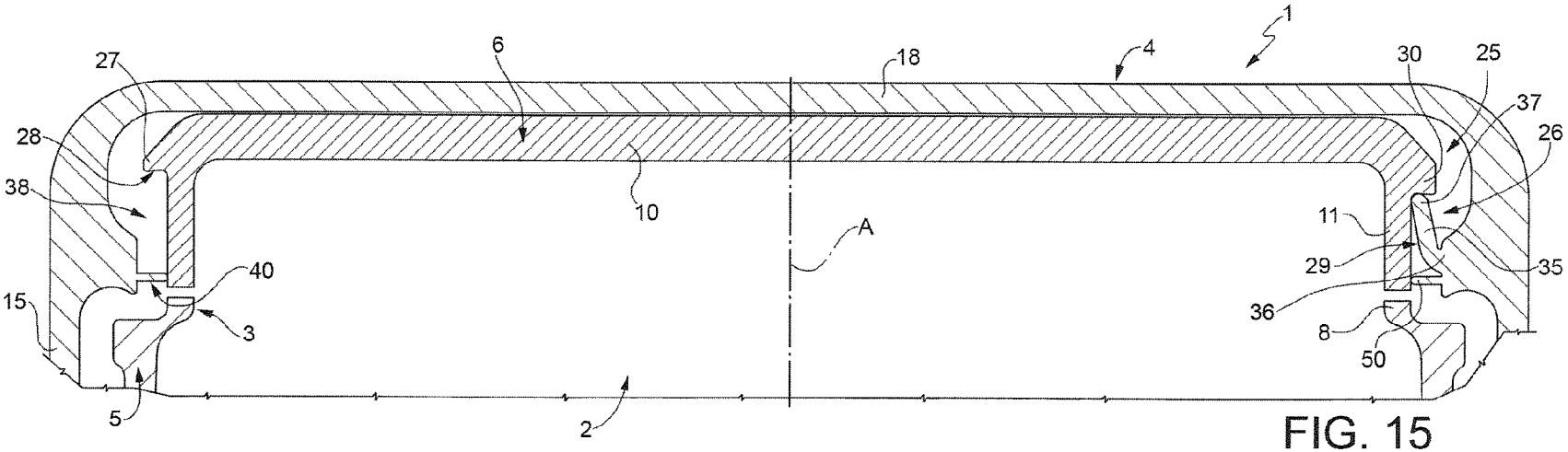
FIG. 15 is a section analogous to the one of FIG. 4 showing a further possible variant of the FIG. 1 closure.

In the solution of FIG. 15, flow hampering means 40 comprise an annular flow hampering element 50 axially spaced from opening elements 29. In particular, with reference to a direction parallel to axis A, flow hampering element 50 is arranged on cap 4 between thread 16 and second opening promoting means 26. In the example shown in FIG. 15, flow hampering element 50 cooperates with or without contact with annular edge 11 of cover portion 6. It is clear that the same barrier effect may be achieved by arranging the flow hampering element 50 so as to cooperate with another part of cover portion 6.

It should be noted that flow hampering element 50, instead of being formed by a single continuous body, may be also formed by a plurality of side-by-side spaced portions similar to portions 49 shown in the solution of FIG. 14.

In use, the first opening of the container is obtained in a single step by unscrewing cap 4 off pouring spout 2.

As cap 4 is turned about axis A anticlockwise in FIG. 1, mating threads 16 and 17 simultaneously move cap 4 axially away from pouring spout 2 so as to break connecting means 22; as a result of this action, tamperproof ring 20 is retained resting axially against the bottom annular rib of neck 5.

Upon further rotation of cap 4, each opening element 29 comes into contact with the respective cam element 30. In this condition, the leading edge of each flap 35 in the direction of rotation of cap 4 slides along the ramp-shaped edge 31 of the relative cam element 30; the result is a sudden increase of the lifting thrust along axis A produced by the cap 4 on the cover portion 6.

In practice, as a consequence of the contact of each opening element 29 with the ramp-shaped edge 31 of the respective cam element 30, the opening element 29 moves away from annular rim 27.

By continuing the rotation of the cap 4, each flap 35 reaches the edge 32 of the relative cam element 30, where the maximum level of the material tension is produced so determining the start of the breaking of the weakening line 9 and therefore the start of the detachment of the cover portion 6 from the neck 5.

In practice, the interaction of each opening element 29 with the relative cam element 30 has the effect of amplifying locally the vertical action produced by thread 16 and thread 17 on the movement of the cap 4.

When cap 4 is completely removed from pouring spout 2, cover portion 6 is retained within the containing zone of the cap 4 so as not to come off the latter unintentionally.

The container can be closed again by simply screwing cap 4 onto pouring spout 2.

In this condition, flow hampering means 40 limit the possible entry of the pourable product in the zone comprised between end wall 18 of cap 4 and cover portion 6. Moreover, flow hampering means 40 also have the function of limiting the spillage of the pourable product possibly entered in the containing zone 38 of cap 4 despite the barrier represented by the same flow hampering means 40.

The adoption of annular rib 45 on annular edge 11 of cover portion 6 has the effect of increasing the barrier action performed by flow hampering means 40.

It should be noted that the provision of flow hampering means 40 on cap 4 does not affect the opening and the reclosing of the container.

Last but not least, the minimization of possible spillage of the pourable product during handling of the cap 4 is obtained through a very limited addition of plastic material with respect to the known solutions, so as to have only a marginal impact on the overall cost of the closure 1.

Clearly, changes may be made to the closure 1 as described and illustrated herein without, however, departing from the scope as defined in the accompanying claims.

The invention claimed is:

1. A closure for a container of a pourable product, said closure comprising:

a pouring spout having a neck to define a product pour opening and a cover portion integral with said neck and closing one end of the neck;

a cap which can be fitted to, and removed from, the pouring spout and which has a lateral wall cooperating in use with said neck and an end wall facing in use said cover portion;

a weakening line provided on said end of said neck;

first opening promoting means provided on said pouring spout; and second opening promoting means provided on said cap and arranged for engaging said first opening promoting means upon removal of said cap from the pouring spout to produce separation of the cover portion from said neck along the weakening line; after separation, said cover portion being held by said second opening promoting means in a containing zone of said cap limited by said end wall and by an adjacent portion of said lateral wall;

characterized by further comprising flow hampering means for limiting, after separation of said cover portion from said neck, the product flow towards and/or from said containing zone.

2. A closure as claimed in claim 1, wherein said flow hampering means project inside said cap from the lateral wall thereof.

3. A closure as claimed in claim 1, wherein said second opening promoting means comprise a number of opening elements projecting inside said cap from the lateral wall thereof and angularly spaced from one another around an axis of said cap.

4. A closure as claimed in claim 3, wherein said flow hampering means comprise a number of flow hampering elements angularly interposed between said opening elements.

5. A closure as claimed in claim 4, wherein said flow hampering elements have sizes, in a direction parallel to said axis, smaller than the sizes of said opening elements in said direction.

6. A closure as claimed in claim 4, wherein each flow hampering element has opposite angular ends contacting respective adjacent opening elements.

7. A closure as claimed in claim 6, wherein said opposite angular ends of each flow hampering element taper to the respective adjacent opening elements.

8. A closure as claimed in claim 4, wherein each flow hampering element has opposite angular ends spaced from the respective adjacent opening elements.

9. A closure as claimed in claim 6, wherein each flow hampering element has a partial cut in a position interposed between said opposite angular ends.

10. A closure as claimed in claim 6, wherein each flow hampering element has a through cut dividing the flow hampering element in two separate portions.

11. A closure as claimed in claim 1, wherein said flow hampering means are spaced from said second opening promoting means along a direction parallel to an axis of said cap.

12. A closure as claimed in claim 1, wherein said flow hampering means cooperate with or without contact with said cover portion for limiting, after separation of the cover portion from said neck, the product flow towards and/or from said containing zone.

13. A closure as claimed in claim 1, wherein the closure further comprises an annular rib provided on said cover portion in a position adjacent to said weakening line, protruding towards said lateral wall of said cap and cooperating with or without contact with said flow hampering means.

14. A closure as claimed in claim 13, wherein said flow hampering means cooperate with or without contact with a surface of said annular rib facing said weakening line.

15. A closure as claimed in claim 13, wherein said flow hampering means cooperate in use with or without contact with a surface of said annular rib facing said lateral wall of said cap.

16. A closure as claimed in claim 13, wherein said flow hampering means cooperate with or without contact with a surface of said annular rib opposite another surface of the annular rib facing said weakening line.

17. A closure as claimed in claim 1, wherein said first opening promoting means comprise an annular rim protruding outwards from said cover portion.

18. A closure as claimed in claim 1, wherein the closure further comprises cam means for transforming a rotation impressed to said cap about an axis of said cap into a stroke of said cap having a rotational component about the same axis and a translational component along said axis to couple/detach said cap with/from said pouring spout, and wherein said first opening promoting means and said second opening promoting means comprise at least one further cam element configured to enhance the lifting thrust produced by the cap on the cover portion as a result of the action of said cam means during removal of said cap from said pouring spout.

19. A closure as claimed in claim 18, wherein said cam element is arranged along a portion of said annular rim and extends from said annular rim towards said neck.

* * * * *